US010849364B2

(12) United States Patent
Chen

(10) Patent No.: US 10,849,364 B2
(45) Date of Patent: Dec. 1, 2020

(54) ATOMIZING DEVICE AND ELECTRONIC CIGARETTE WITH THE SAME

(71) Applicant: SHENZHEN SMOORE TECHNOLOGY LIMITED, Shenzhen (CN)

(72) Inventor: Zhiping Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 346 days.

(21) Appl. No.: 16/109,433

(22) Filed: Aug. 22, 2018

(65) Prior Publication Data

US 2018/0360126 A1 Dec. 20, 2018

Related U.S. Application Data

(63) Continuation of application No. PCT/CN2017/085996, filed on May 25, 2017.

(51) Int. Cl.
*A24F 13/00* (2006.01)
*A24F 47/00* (2020.01)

(52) U.S. Cl.
CPC ..... *A24F 47/008* (2013.01)

(58) Field of Classification Search
CPC ..... A24F 47/00
USPC ..... 131/328–329
See application file for complete search history.

(56) References Cited

U.S. PATENT DOCUMENTS

2018/0161525 A1* 6/2018 Liu ..... A61M 15/0085

FOREIGN PATENT DOCUMENTS

CN 203633512 U 6/2014

* cited by examiner

*Primary Examiner* — Phuong K Dinh
(74) *Attorney, Agent, or Firm* — Hemisphere Law, PLLC; Zhigang Ma

(57) ABSTRACT

The present disclosure provides an atomizing device including a cartridge and a nozzle assembly detachably mounted at one end of the cartridge; the cartridge forms a liquid storage cavity, one end of the cartridge corresponding to the nozzle assembly is provided with a liquid injection opening such that liquid can be injected to the liquid storage cavity through the liquid injection opening. A first seal is arranged on the nozzle assembly, and the first seal includes a sealing portion and a blocking portion; and a shape of an outer ring of the blocking portion corresponds to a shape of an inner wall of the liquid injection opening, when the nozzle assembly is mounted onto the cartridge, the blocking portion blocks smoke oil from the inner wall of the liquid injection opening into the liquid storage cavity.

19 Claims, 6 Drawing Sheets

ATOMIZING DEVICE AND ELECTRONIC CIGARETTE WITH THE SAME

TECHNICAL FIELD

The present disclosure relates to substitutes for tobacco cigarettes, and more particularly, to an atomizing device and an electronic cigarette with the same.

BACKGROUND

At present, electronic cigarettes have become a more mature alternative to tobaccos on the market; the electronic cigarettes atomize smoke oil in an atomizer by heating a heating element through a battery and thus forming harmless smoke. As the core component, the atomizer plays a vital role in the performance of the electronic cigarette.

At present, there are a lot of reusable atomizers to which smoke oil can be repeatedly added. However, in this type of atomizer, during the process of opening and closing an injector cavity thereof, there will be often liquid smoke overflow, which will contaminate an outer surface of the atomizer, giving customers a very bad use experience.

SUMMARY OF THE DISCLOSURE

The present disclosure aims to provide an improved atomizing device and an electronic cigarette with the same.

An atomizing device, wherein the atomizing device includes a cartridge and a nozzle assembly detachably mounted at one end of the cartridge; the cartridge forms a liquid storage cavity, one end of the cartridge corresponding to the nozzle assembly is provided with a liquid injection opening such that liquid can be injected to the liquid storage cavity through the liquid injection opening; a first seal is arranged on the nozzle assembly, and the first seal includes a sealing portion for providing sealing between the liquid injection opening and the nozzle assembly and a blocking portion extending towards the liquid injection opening from the sealing portion; and a shape of an outer ring of the blocking portion corresponds to a shape of an inner wall of the liquid injection opening, when the nozzle assembly is mounted onto the cartridge, the blocking portion blocks smoke oil from the inner wall of the liquid injection opening into the liquid storage cavity.

In an embodiment, the blocking portion includes a blocking ring set up along a circumference of the outer ring of the blocking portion.

In an embodiment, the blocking ring is made of soft material, a size of the outer ring of the blocking ring is greater than that of an inner ring of the liquid injection opening, and a guide part for guiding insertion of the blocking ring into the liquid injection opening is arranged along a circumference of one side of the blocking ring facing away from the sealing portion.

In an embodiment, the first seal includes a tubular body, the sealing portion is a sealing ring protruding outwards from a circumference of an outer ring of the tubular body; the blocking portion is arranged at one end of the tubular body corresponding to the liquid storage cavity, and the blocking ring is spaced from the sealing portion.

In an embodiment, the nozzle assembly includes a nozzle, the first seal is arranged at one end of the nozzle corresponding to the cartridge, and the sealing portion is clamped between two opposite ends of the cartridge and the nozzle.

In an embodiment, the atomizing device further includes a vent pipe running through the cartridge, the liquid injection opening is an annular opening of the liquid storage cavity directly corresponding to the nozzle assembly; the nozzle assembly includes a connecting member connected to the vent pipe, the vent pipe is sealed with the connecting member, and an outlet of the nozzle assembly communicates with the vent pipe.

In an embodiment, the first seal is sleeved on the connecting member, and the connecting member is screwed outside the vent pipe and sealed with the vent pipe.

In an embodiment, the atomizing device further includes a connecting assembly arranged at the other end of the cartridge; and a flange is arranged on an inner ring of one end of the cartridge corresponding to the connecting assembly, extending from a circumference of the inner ring to the center; the vent pipe extends out from the cartridge through an inner hole of the flange and is fixed to the connecting assembly; the outer ring of the vent pipe is equipped with a stopping ring located inside the liquid storage cavity, and the stopping ring and the connecting assembly are respectively in contact with and sealed with an inner side and an outer side of the flange.

In an embodiment, the vent pipe includes a first pipe section and a second pipe section, one end of the first pipe section away from the second pipe section is correspondingly connected to the nozzle assembly, and one end of the second pipe section away from the first pipe section is correspondingly connected to the connecting assembly; an inner diameter and an outer diameter of the second pipe section are greater than an inner and an outer diameter of the first pipe section respectively; the stopping ring is arranged in an outer ring of the second pipe section; and the atomizing device also includes a heating assembly arranged in the second pipe section, an injection inlet communicating with the liquid storage cavity is formed on a side wall of the second pipe section.

The present disclosure further provides an electronic cigarette including the above atomizing device.

The atomizing device and the electronic cigarette of the present disclosure have the following beneficial effects: after the blocking portion of the atomizing device and the electronic cigarette blocks the smoke oil from the inner wall of the liquid injection opening in the liquid storage cavity, the smoke oil can be reduced to or prevented from contacting the sealing portion, thereby preventing more smoke oil from adhering to the sealing portion. Thus, no smoke oil will overflow the sealing portion, guaranteeing the cleaning of the outer surface of the atomizing device.

BRIEF DESCRIPTION OF THE DRAWINGS

The present disclosure will be described in more detail with reference to the accompany drawings and the embodiments, where in the drawings.

PREFERRED EMBODIMENTS

For clearly understanding technical features, purpose, and effect of the present disclosure, embodiments are given in detail hereinafter with reference to the accompanying drawings.

Figure 1:
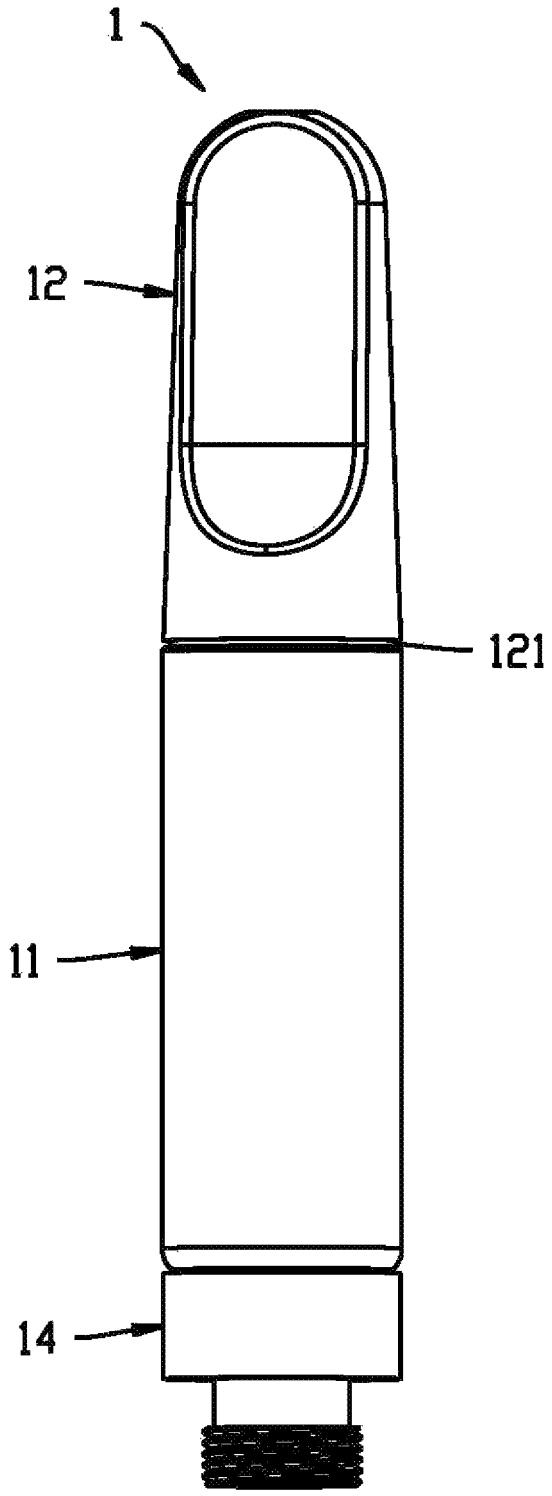
FIG. 1 is a perspective view of an atomizing device in an embodiment of the present disclosure.

Referring to FIG. 1, an electronic cigarette in an embodiment of the present disclosure includes an atomizing device 1 and a power supply device. After the atomizing device 1 and the power supply device are being assembled, the power supply device provides electrical energy to the atomizing device 1 to heat smoke oil, allowing users to smoke.

Figure 2:
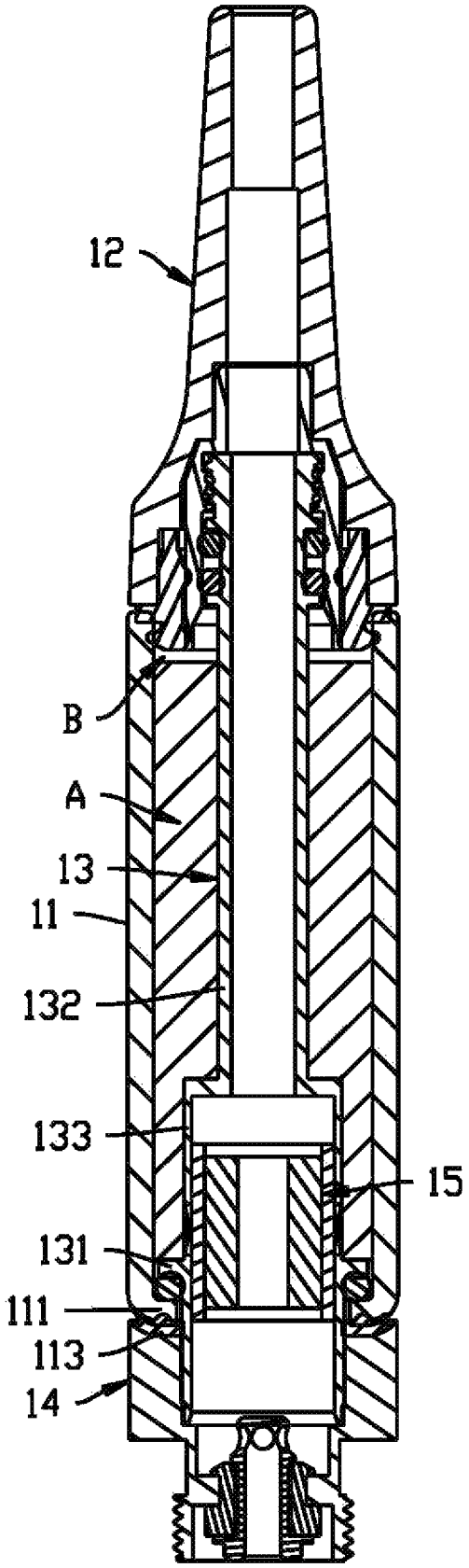
FIG. 2 is a cross-sectional view of the atomizing device in FIG. 1.
Figure 3:
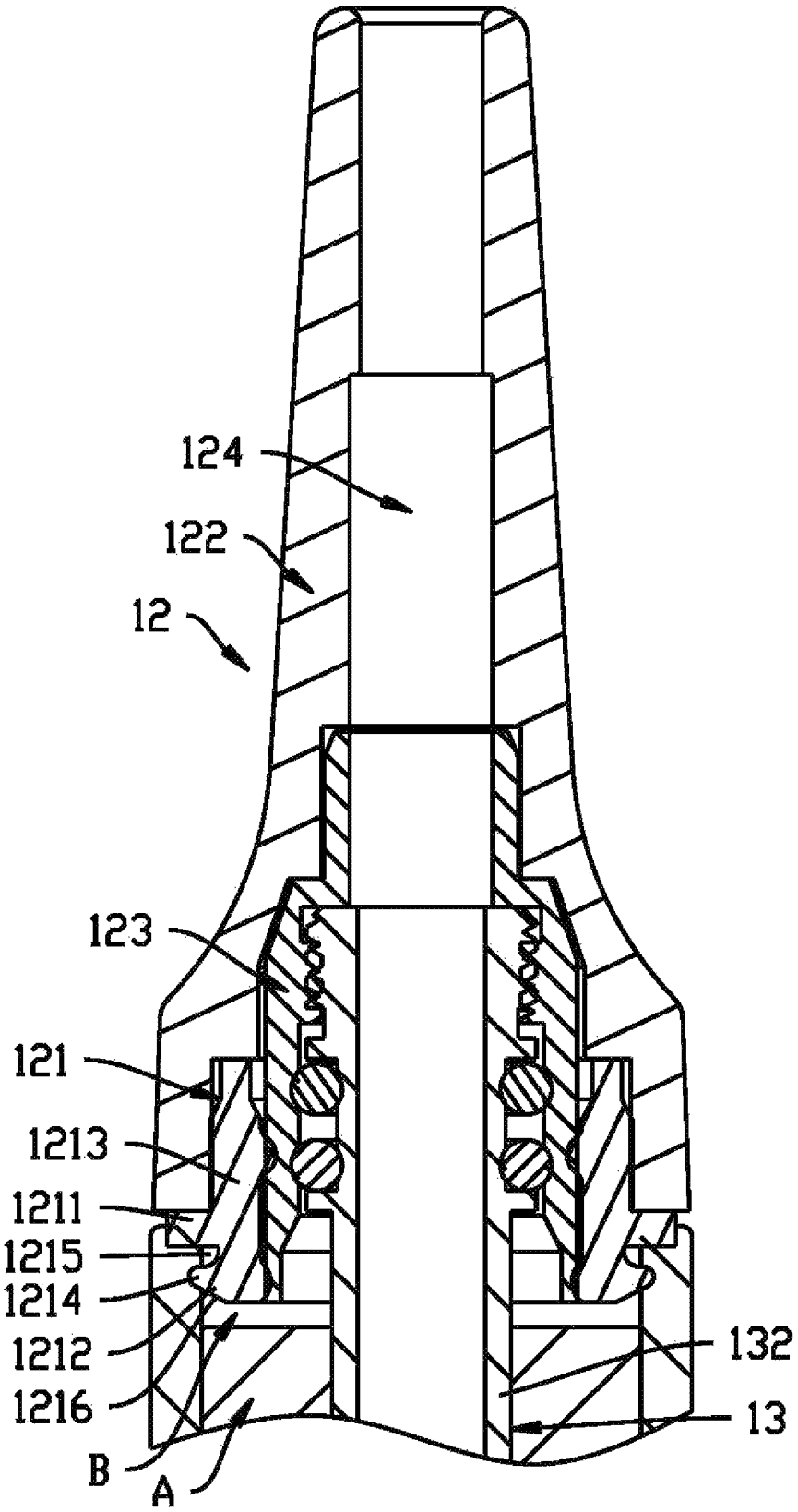
FIG. 3 is a schematic view showing a nozzle assembly, a cartridge, and a vent pipe in FIG. 2 in a assembled state.
Figure 4:
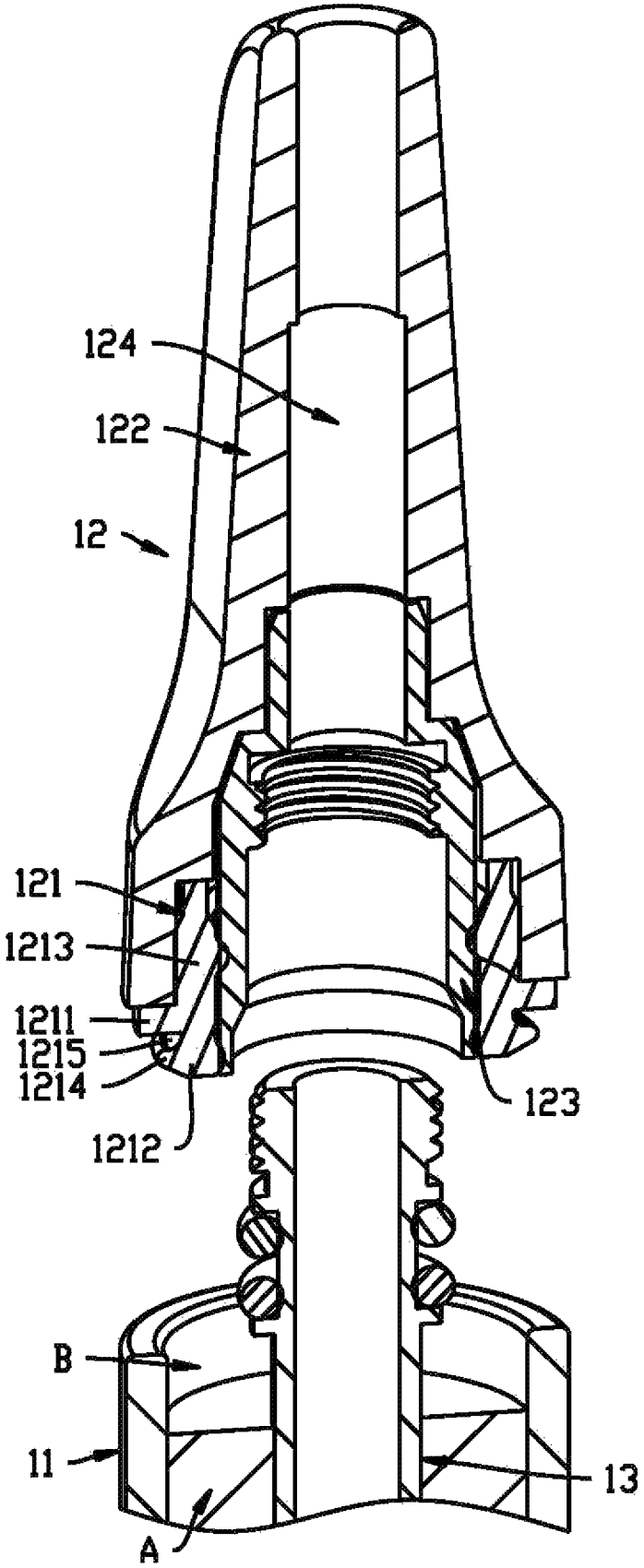
FIG. 4 is a schematic view showing the nozzle assembly, the cartridge, and the vent pipe in FIG. 3 in a disassembled state.

As shown in FIG. 2 to FIG. 4, the atomizing device 1 includes a cartridge 11 and a nozzle assembly 12 detachably mounted at one end of the cartridge 11. The cartridge 11 forms a liquid storage cavity A. One end of the cartridge 11 corresponding to the nozzle assembly 12 is provided with a liquid injection opening B such that smoke oil can be injected to the liquid storage A through the liquid injection opening B. After the smoke oil in the liquid storage cavity A is used up, the liquid injection opening B can be opened such that the smoke oil can be injected into the liquid storage cavity A, thus, the electronic cigarette can be reused.

A first seal 121 is arranged on the nozzle assembly 12. The first seal 121 is provided with a sealing portion 1211 for sealing between the liquid injection opening B and the nozzle assembly 12 and a blocking portion 1212 extending into the liquid injection opening B from the sealing portion 1211.

In general, the sealing portion 1211 is made of soft material. The sealing portion 1211 could block the liquid injection opening B after the nozzle assembly 12 is mounted on the cartridge 11 and seal the engaging position between the liquid injection opening B and the nozzle assembly 12.

A shape of an outer ring of the blocking portion 1212 corresponds to a shape of an inner wall of the liquid injection opening B. When the nozzle assembly 12 is mounted on the cartridge 11, the blocking portion 1212 cooperates with the inner wall of the liquid injection opening B, blocking the smoke oil from the inner wall of the liquid injection opening B in the liquid storage cavity A.

After the blocking portion 1212 blocks the smoke oil from the inner wall of the liquid injection opening B in the liquid storage cavity A, the smoke oil can be reduced or prevented from contacting the sealing portion 1211, thus, less smoke oil may adhere on the sealing portion 1211. Because, when more smoke oil adheres to the sealing portion 1211 and the nozzle assembly is sealed with the cartridge 11, the smoke oil on the sealing portion 1211 may be squeezed to an outer surface of the atomizing device 1 to contaminate the appearance of the atomizing device 1.

The blocking portion 1212 can prevent more smoke oil from adhering to the sealing portion 1211 when the atomizing device 1 is being used. When the nozzle assembly 12 is being mounted to the cartridge 11, the blocking portion 1212 extends into the cartridge 11 firstly to push the smoke oil adhering from the inner wall of the cartridge 11 into the cartridge 11, thereby preventing more smoke oil from adhering to the sealing portion 1211.

The first seal 121 includes a tubular body 1213, and the sealing portion 1211 is a sealing ring protruding outwards from a circumference of an outer ring of the tubular body 1213. The blocking portion 1212 is arranged at one end of the tubular body 1213 corresponding to the liquid storage cavity A. In some embodiments, the blocking portion 1212 includes a blocking ring 1214 protruding outwards from the outer ring of the tubular body 1213 along the circumference.

The blocking ring 1214 is arranged on the outer ring of the tubular body 1213, thus, the blocking ring 1214 can block the smoke oil from the inner wall of the liquid injection opening B into the liquid storage cavity A. In addition, with the blocking ring 1214, an interval can be formed between the blocking ring 1214 and the sealing portion 1211 to form an annular groove 1215 between the blocking ring 1214 and the sealing portion 1211. With the annular groove 1215, the smoke oil can be prevented from entering onto the sealing portion 1211 by capillary force.

In other embodiments, the blocking portion 1212 may also be a cylindrical structure or a columnar structure, extending towards the liquid storage cavity A from the sealing portion 1211; when the blocking portion 1212 is inserted into the liquid storage cavity A, the blocking portion 1212 blocks the smoke oil from the inner wall of the liquid injection opening B into the liquid storage cavity A.

In some embodiments, the blocking ring 1214 is made of soft material, and an outer ring of the blocking ring 1214 is greater than an inner ring of the liquid injection opening B; a guide part 1216 is arranged on one side of the blocking ring 1214 facing away from the sealing portion 1211 for guiding the insertion of the blocking ring 1214 into the liquid injection opening B. The guide part 1216 could be an oblique angle transition structure, a round angle transition structure, or an arc transition structure.

The soft blocking ring 1214 may be deformed in some extent when being inserted into the cartridge 11 to ensure a tight engagement between the outer ring of the blocking ring 1214 and the inner wall of the liquid injection opening B, thereby blocking the smoke oil into the liquid storage cavity A as far as possible. In other embodiments, when the size of the blocking ring 1214 matches the size of the inner ring the cartridge 11, the blocking ring 1214 may also be made of rigid material.

The nozzle assembly 12 further includes a nozzle 122 and a connecting member 123. The nozzle 122 is provided with an outlet 124. The first seal 121 and the connecting member 123 are arranged at the same end of the nozzle 122 and located at one end of the nozzle 122 corresponding to the cartridge 11. The sealing portion 1211 is clamped between two opposite ends of the cartridge 11 and the nozzle 122 when the nozzle assembly 12 is mounted on the cartridge 11.

Since the blocking portion 1212 blocks the smoke oil from the inner wall of the liquid injection opening B into the liquid storage cavity A firstly, no smoke oil overflow the sealing portion 1211, which guarantees the cleaning of the outer surface of the atomizing device 1.

The atomizing device 1 further includes a vent pipe 13 running through the cartridge 11. The outlet 124 of the nozzle assembly 12 communicates with the vent pipe 13.

The liquid storage cavity A is formed between an inner wall of the cartridge 11 and an outer wall of the vent pipe 13, and the liquid injection opening B is an annular opening of the liquid storage cavity A directly corresponding to the nozzle assembly 12. After the nozzle assembly 12 is removed, the smoke oil can be injected through the liquid injection opening B.

Further, the connecting member 123 is connected with the vent pipe 13, and the vent pipe 13 is sealed with the connecting member 123. During the installation of the nozzle assembly 12, the first seal 121 rotates with the connecting member 123 over the vent pipe 13 so that the smoke oil from the inner wall surface of the liquid injection opening B is blocked into the liquid storage cavity A when the blocking portion 1213 rotates.

After the nozzle assembly 12 is installed, the connecting member 123 is fixed and sealed with the vent pipe 13, providing sealing between the cartridge 11 and nozzle 122.

In some embodiments, the first seal 121 is sleeved on the connecting member 123, and the connecting member 123 is screwed on the vent pipe 13 and sealed with the vent pipe 13. A sealing ring is sleeved on the vent pipe 13. After the connecting member 123 is screwed on the vent pipe 13, the sealing ring provides sealing between the connecting member 123 and the vent pipe 13.

In other embodiments, the connecting member 123 can also be fixed with the vent pipe 13, at this time, the end of the cartridge 11 corresponding to the nozzle assembly 12 can be provided with an end wall, and the liquid injection opening B is formed in the end wall. Further, the connecting member 123 and the first seal 121 may be integrally formed or embedded together or positioned tightly.

Figure 5:
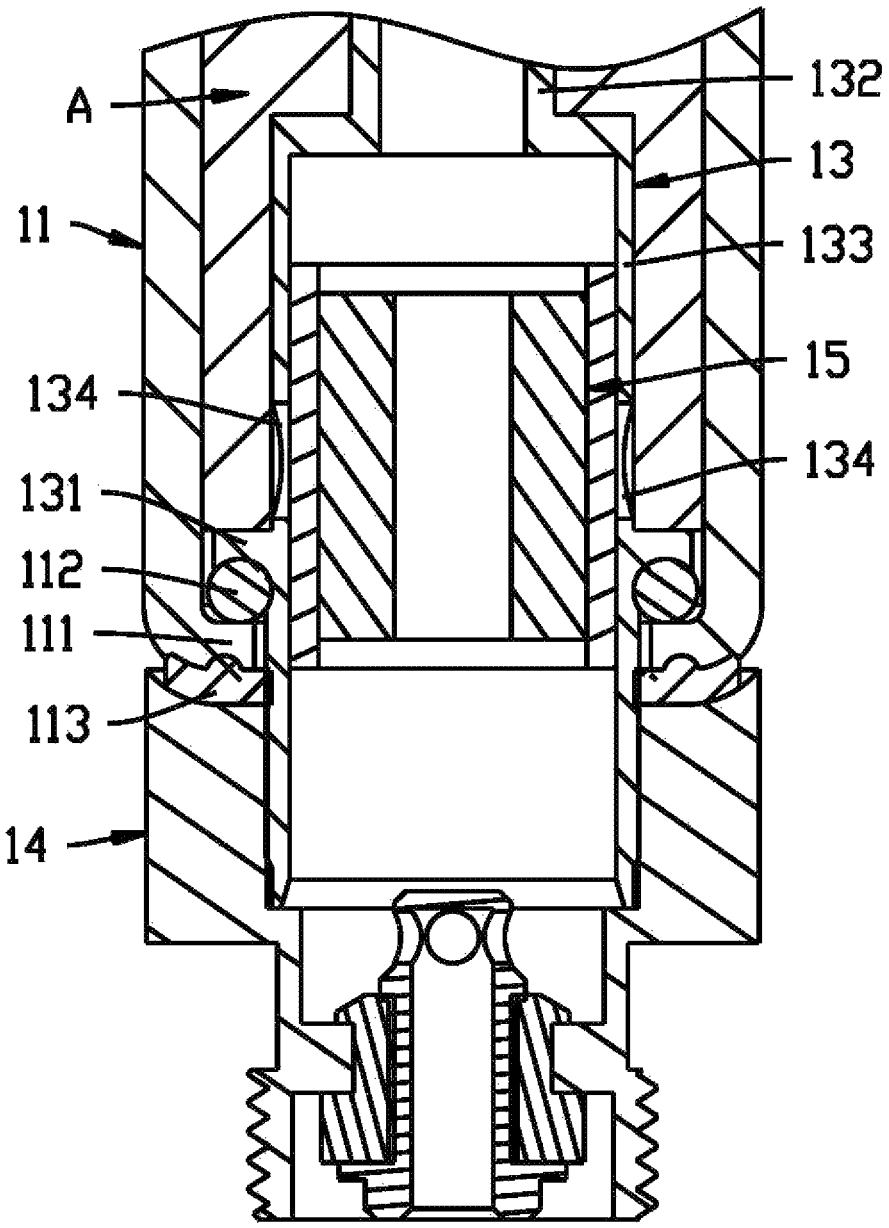
FIG. 5 is a schematic view showing a connecting assembly, the cartridge, and the vent pipe in FIG. 2 in an assembled state.
Figure 6:
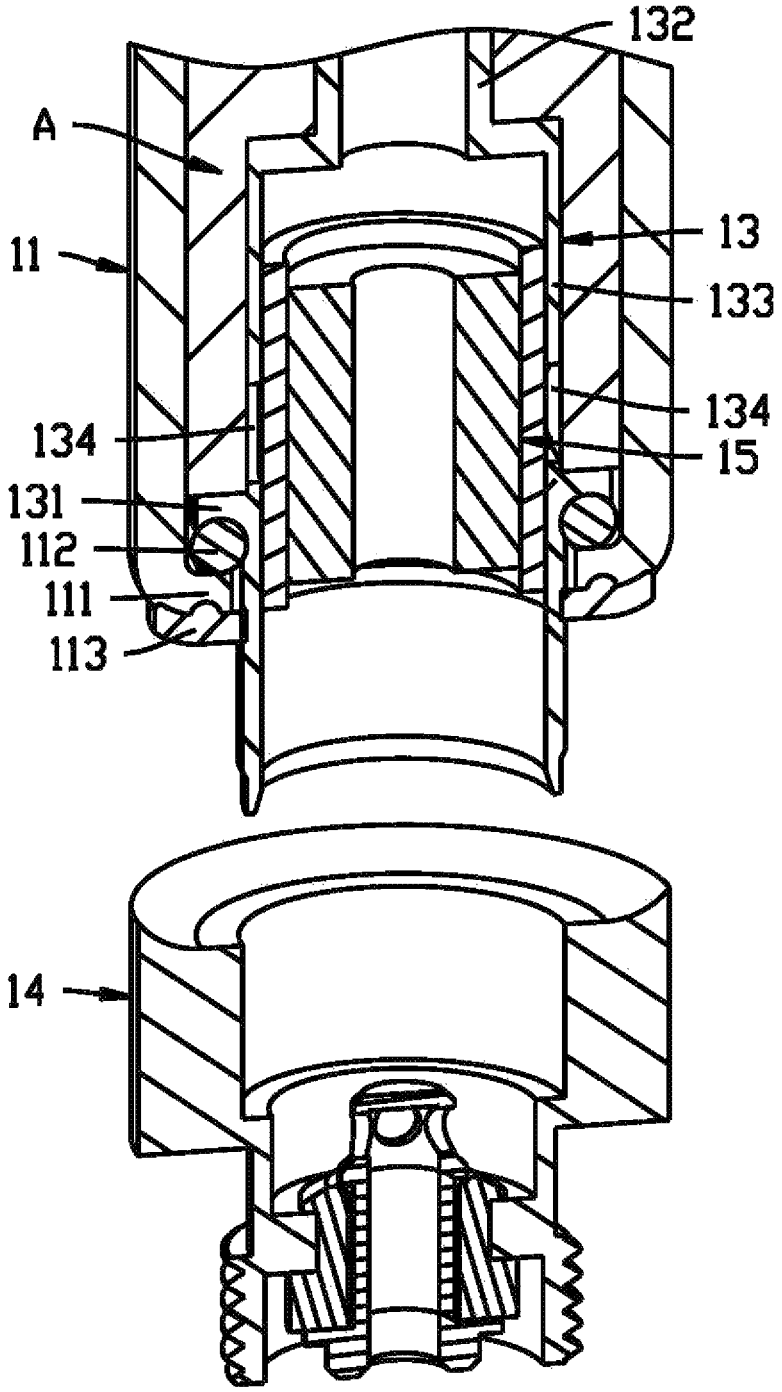
FIG. 6 is a cross-sectional view showing the connecting assembly, the cartridge, and the vent pipe in FIG. 5 in a disassembled view.

As shown in FIG. 2, FIG. 5, and FIG. 6, in some embodiments, the atomizing device 1 further includes a connecting assembly 14 installed on the other end of the cartridge 11, and the connecting assembly 14 could be connected to the power supply device to enable circuit conduction.

A flange 111 is arranged on an inner ring of one end of the cartridge 11 corresponding to the connecting assembly 14, extending from a circumference of the inner ring of the cartridge 11 to the center thereof. The vent pipe 13 extends out from the cartridge 11 through an inner hole of the flange 111 and is fixedly connected with the connecting assembly 14.

An outer ring of the vent pipe 13 is equipped with a stopping ring 131, and the stopping ring 131 is located inside the liquid storage cavity A. The stopping ring 131 and the connecting assembly 14 are respectively in contact with and sealed with inner and outer sides of the flange 111.

During assembly, the vent pipe 13 is inserted into the cartridge 11 from one end of the nozzle 122, so that the stopping ring 131 is positioned against the flange 111, and the vent pipe 13 protrudes from the end of the flange 111 to be riveted to the connecting assembly 14. This assembly method can facilitate the installation of the sealing member between the two opposite sides of the flange 111, which improves the sealing performance after the assembly of the vent pipe 13 and the connecting assembly 14.

In some embodiments, a second seal 112 is arranged between the stopping ring 131 and the flange 111, and a third seal 113 is arranged between the stopping ring 131 and the connecting assembly 14. The second seal 112 could first be sleeved on the vent pipe 13 by the end of the vent pipe 13 corresponding to the connecting assembly 14; and when the vent pipe 13 runs through the inner hole of the flange 111, the second seal 112 is clamped by the flanged 111 and the stopping ring 131 to provide sealing at this position.

After the vent pipe 13 runs through the inner hole of the flange 111, the third seal 113 is sleeved on the end of the vent pipe 13 extending out from the inner hole of the flange 111, and then the connecting assembly 14 is installed to abut the third seal 113 against an outer side of the flange 111. The third seal 113 is clamped between the flange 111 and the connecting assembly 14, providing sealing at this position.

In some embodiments, the vent pipe 13 includes a first pipe section 132 and a second pipe section 133. An inner diameter and an outer diameter of the second pipe section 133 are greater than an inner diameter and an outer diameter of the first pipe section 132 respectively. Further, the stopping ring 131 is arranged on an outer ring of the second pipe section 133 and can abut the flange 111 when being inserted into the cartridge 11.

One end of the first pipe section 132 away from the end of the second pipe section 133 is correspondingly connected to the nozzle assembly 12. One end of the second pipe section 133 away from the end of the first pipe section 132 is correspondingly connected to the connecting assembly 14.

Due to the large inner diameter of the second pipe section 133, the atomizing device 1 further includes a heating assembly 15 arranged in the second pipe section 133. A side wall of the second pipe section 133 is provided with a liquid inlet 134 communicating with the liquid storage cavity A. The smoke oil is adsorbed and atomized by the heating assembly 15 after entering the second pipe section 133, forming the smoke which flows from the first pipe section 132 into the nozzle 122. The vent pipe 13 has two ends of different shapes, which not only provides the installation space of the heating assembly 15, but also increases the space of the liquid storage cavity A, which is beneficial to increase the storage volume of the smoke oil.

It can be understood that the above technical features can be used in any combination without limitation.

The contents described above are only preferred embodiments of the present disclosure, but the scope of the present disclosure is not limited to the embodiments. Any ordinarily skilled in the art would make any modifications or replacements to the embodiments in the scope of the present disclosure, and these modifications or replacements should be included in the scope of the present disclosure. Thus, the scope of the present disclosure should be subjected to the claims.

What is claimed is:

1. An atomizing device (1), wherein the atomizing device (1) comprises a cartridge (11) and a nozzle assembly (12) detachably mounted at one end of the cartridge (11); the cartridge (11) forms a liquid storage cavity (A), one end of the cartridge (11) corresponding to the nozzle assembly (12) is provided with a liquid injection opening (B) such that liquid can be injected to the liquid storage cavity (A) through the liquid injection opening (B); a first seal (121) is arranged on the nozzle assembly (12), and the first seal (121) comprises a sealing portion (1211) for providing sealing between the liquid injection opening (B) and the nozzle assembly (12) and a blocking portion (1212) extending towards the liquid injection opening (B) from the sealing portion (1211); and a shape of an outer ring of the blocking portion (1212) corresponds to a shape of an inner wall of the liquid injection opening (B), when the nozzle assembly (12) is mounted onto the cartridge (11), the blocking portion (1212) blocks smoke oil from the inner wall of the liquid injection opening (B) into the liquid storage cavity (A).

2. According to the atomizing device (1) of claim 1, wherein the blocking portion (1212) comprises a blocking ring (1214) set up along a circumference of the outer ring of the blocking portion (1212).

3. According to the atomizing device (1) of claim 2, wherein the blocking ring (1214) is made of soft material, a size of the outer ring of the blocking ring (1214) is greater than that of an inner ring of the liquid injection opening (B), and a guide part (1216) for guiding insertion of the blocking ring (1214) into the liquid injection opening (B) is arranged along a circumference of one side of the blocking ring (1214) facing away from the sealing portion (1211).

4. According to the atomizing device (1) of claim 2, wherein the first seal (121) comprises a tubular body (1213), the sealing portion (1211) is a sealing ring protruding outwards from a circumference of an outer ring of the tubular body (1213); the blocking portion (1212) is arranged at one end of the tubular body (1213) corresponding to the liquid storage cavity (A), and the blocking ring (1214) is spaced from the sealing portion (1211).

5. According to the atomizing device (1) of claim 1, wherein the nozzle assembly (12) further comprises a nozzle (122), the first seal (121) is arranged at one end of the nozzle (122) corresponding to the cartridge (11), and the sealing portion (1211) is clamped between two opposite ends of the cartridge (11) and the nozzle (122).

6. According to the atomizing device (1) of claim 5, wherein the atomizing device (1) further comprises a vent pipe (13) running through the cartridge (11), the liquid injection opening (B) is an annular opening of the liquid storage cavity (A) directly corresponding to the nozzle assembly (12); the nozzle assembly (12) comprises a connecting member (123) connected to the vent pipe (13), the vent pipe (13) is sealed with the connecting member (123), and an outlet (124) of the nozzle assembly (12) communicates with the vent pipe (13).

7. According to the atomizing device (1) of claim 6, wherein the first seal (121) is sleeved on the connecting member (123), and the connecting member (123) is screwed outside the vent pipe (13) and sealed with the vent pipe (13).

8. According to the atomizing device (1) of claim 6, wherein the atomizing device (1) further comprises a connecting assembly (14) arranged at the other end of the cartridge (11); and a flange (111) is arranged on an inner ring of one end of the cartridge (11) corresponding to the connecting assembly (14), extending from a circumference of the inner ring to the center; the vent pipe (13) extends out from the cartridge (11) through an inner hole of the flange (111) and is fixed to the connecting assembly (14); the outer ring of the vent pipe (13) is equipped with a stopping ring (131) located inside the liquid storage cavity (A), and the stopping ring (131) and the connecting assembly (14) are respectively in contact with and sealed with an inner side and an outer side of the flange (111).

9. According to the atomizing device (1) of claim 8, wherein the vent pipe (13) comprises a first pipe section (132) and a second pipe section (133), one end of the first pipe section (132) away from the second pipe section (133) is correspondingly connected to the nozzle assembly (12), and one end of the second pipe section (132) away from the first pipe section (132) is correspondingly connected to the connecting assembly (14); an inner diameter and an outer diameter of the second pipe section (133) are greater than an inner and an outer diameter of the first pipe section (132) respectively; the stopping ring (131) is arranged in an outer ring of the second pipe section (133); and the atomizing device (1) also comprises a heating assembly (15) arranged in the second pipe section (133), an injection inlet (134) communicating with the liquid storage cavity (A) is formed on a side wall of the second pipe section (133).

10. According to the atomizing device (1) of claim 3, wherein the first seal (121) comprises a tubular body (1213), the sealing portion (1211) is a sealing ring protruding outwards from a circumference of an outer ring of the tubular body (1213); the blocking portion (1212) is arranged at one end of the tubular body (1213) corresponding to the liquid storage cavity (A), and the blocking ring (1214) is spaced from the sealing portion (1211).

11. According to the atomizing device (1) of claim 2, wherein the nozzle assembly (12) further comprises a nozzle (122), the first seal (121) is arranged at one end of the nozzle (122) corresponding to the cartridge (11), and the sealing portion (1211) is clamped between two opposite ends of the cartridge (11) and the nozzle (122).

12. According to the atomizing device (1) of claim 3, wherein the nozzle assembly (12) further comprises a nozzle (122), the first seal (121) is arranged at one end of the nozzle (122) corresponding to the cartridge (11), and the sealing portion (1211) is clamped between two opposite ends of the cartridge (11) and the nozzle (122).

13. According to the atomizing device (1) of claim 11, wherein the atomizing device (1) further comprises a vent pipe (13) running through the cartridge (11), the liquid injection opening (B) is an annular opening of the liquid storage cavity (A) directly corresponding to the nozzle assembly (12); the nozzle assembly (12) comprises a connecting member (123) connected to the vent pipe (13), the vent pipe (13) is sealed with the connecting member (123), and an outlet (124) of the nozzle assembly (12) communicates with the vent pipe (13).

14. According to the atomizing device (1) of claim 12, wherein the atomizing device (1) further comprises a vent pipe (13) running through the cartridge (11), the liquid injection opening (B) is an annular opening of the liquid storage cavity (A) directly corresponding to the nozzle assembly (12); the nozzle assembly (12) comprises a connecting member (123) connected to the vent pipe (13), the vent pipe (13) is sealed with the connecting member (123), and an outlet (124) of the nozzle assembly (12) communicates with the vent pipe (13).

15. According to the atomizing device (1) of claim 13, wherein the atomizing device (1) further comprises a connecting assembly (14) arranged at the other end of the cartridge (11); and a flange (111) is arranged on an inner ring of one end of the cartridge (11) corresponding to the connecting assembly (14), extending from a circumference of the inner ring to the center; the vent pipe (13) extends out from the cartridge (11) through an inner hole of the flange (111) and is fixed to the connecting assembly (14); the outer ring of the vent pipe (13) is equipped with a stopping ring (131) located inside the liquid storage cavity (A), and the stopping ring (131) and the connecting assembly (14) are respectively in contact with and sealed with an inner side and an outer side of the flange (111).

16. An electronic device comprising an atomizing device (1), wherein the atomizing device (1) comprises a cartridge (11) and a nozzle assembly (12) detachably mounted at one end of the cartridge (11); the cartridge (11) forms a liquid storage cavity (A), one end of the cartridge (11) corresponding to the nozzle assembly (12) is provided with a liquid injection opening (B) such that liquid can be injected to the liquid storage cavity (A) through the liquid injection opening (B); a first seal (121) is arranged on the nozzle assembly (12), and the first seal (121) comprises a sealing portion (1211) for providing sealing between the liquid injection opening (B) and the nozzle assembly (12) and a blocking portion (1212) extending towards the liquid injection opening (B) from the sealing portion (1211); and a shape of an outer ring of the blocking portion (1212) corresponds to a shape of an inner wall of the liquid injection opening (B), when the nozzle assembly (12) is mounted onto the cartridge (11), the blocking portion (1212) blocks smoke oil from the inner wall of the liquid injection opening (B) into the liquid storage cavity (A).

17. According to the electronic cigarette of claim 16, wherein the blocking portion (1212) comprises a blocking ring (1214) set up along a circumference of the outer ring of the blocking portion (1212).

18. According to the electronic cigarette of claim 17, wherein the blocking ring (1214) is made of soft material, a size of the outer ring of the blocking ring (1214) is greater than that of an inner ring of the liquid injection opening (B), and a guide part (1216) for guiding insertion of the blocking ring (1214) into the liquid injection opening (B) is arranged along a circumference of one side of the blocking ring (1214) facing away from the sealing portion (1211).

19. According to the electronic cigarette of claim 17, wherein the first seal (121) comprises a tubular body (1213), the sealing portion (1211) is a sealing ring protruding outwards from a circumference of an outer ring of the tubular body (1213); the blocking portion (1212) is arranged at one end of the tubular body (1213) corresponding to the liquid storage cavity (A), and the blocking ring (1214) is spaced from the sealing portion (1211).

* * * * *